US005299709A

United States Patent [19]

Beerbower et al.

[11] Patent Number: 5,299,709

[45] Date of Patent: Apr. 5, 1994

[54] ABOVE GROUND FUEL STORAGE TANK

[75] Inventors: James N. Beerbower, Tipp City; Charles L. Allen, Jr., Vandalia; Lowell R. Klaber, Dayton; John F. Kuhl, Cincinnati, all of Ohio

[73] Assignee: Flexicore Systems, Inc., Huber Heights, Ohio

[21] Appl. No.: 4,464

[22] Filed: Jan. 14, 1993

[51] Int. Cl.[5] ..... B65D 25/18

[52] U.S. Cl. ..... 220/445; 220/565; 220/571; 220/660

[58] Field of Search ..... 220/445, 565, 571, 660, 220/681

[56] References Cited

U.S. PATENT DOCUMENTS

| | | | |
|---|---|---|---|
| 3,558,000 | 1/1971 | McCann et al. . | |
| 3,851,611 | 12/1974 | Yamamoto | 220/445 |
| 4,343,413 | 8/1982 | Chatzipetros et al. | 220/445 |
| 4,425,743 | 1/1984 | Bartur . | |
| 4,625,892 | 12/1986 | Carlin, Jr. . | |
| 4,651,893 | 3/1987 | Mooney | 220/445 |
| 4,761,313 | 8/1988 | Jacobs . | |
| 4,826,644 | 5/1989 | Lindquist et al. . | |
| 4,911,326 | 3/1990 | McGouran, Jr. | 220/445 |
| 4,931,235 | 6/1990 | Lindquist et al. . | |
| 4,934,122 | 6/1990 | Lindquist . | |
| 4,963,082 | 10/1990 | Lindquist et al. . | |
| 4,971,214 | 11/1990 | Lillywhite et al. . | |
| 4,986,436 | 1/1991 | Bambacigno et al. . | |
| 5,033,638 | 7/1991 | Cruver et al. . | |
| 5,064,155 | 11/1991 | Bambacigno et al. . | |
| 5,082,138 | 1/1992 | McGarvey | 220/445 |
| 5,126,095 | 6/1992 | Crosno et al. . | |
| 5,203,386 | 4/1993 | Harp . | |

OTHER PUBLICATIONS

ChemVault brochure, Apr. 1991.

ChemVault 900 Gallon, tentative May 2, 1991.

*Primary Examiner*—Joseph Man-Fu Moy

*Attorney, Agent, or Firm*—Killworth, Gottman, Hagan & Schaeff

[57] ABSTRACT

An above ground storage tank is provided having an inner tank for primary storage, and an outer casing surrounding the inner tank. The outer casing includes both a casing body defining an opening, and a removable lid positioned over the opening. A fire-resistant seal is provided between the lid and casing body to inhibit transmission of fire and explosion hazards to stored materials, as well as preventing leaks and spills from escaping containment. It is preferred to further add a weather-resistant sealant around the periphery of the fire-resistant seal to inhibit weathering thereof.

18 Claims, 3 Drawing Sheets

ABOVE GROUND FUEL STORAGE TANK

BACKGROUND OF THE INVENTION

The present invention relates to above ground fuel storage tanks, and in particular to an above ground storage tank having a removable concrete lid with fireproof seals at joints and openings.

Underground tanks have long been used for the storage and safekeeping of fuels and other hazardous materials. However, due to the long-term effects of groundwater and soil contamination from undetected leakage, the costs of remedial measures, and the related costs of removing underground tanks, underground storage is being avoided in favor of above ground storage of fuels and chemicals.

To provide safe storage of such hazardous materials above ground, storage tanks have been developed for fuels and chemicals where an inner tank is completely encased in an outer concrete jacket. For example, Lindquist et al, U.S. Pat. No. 4,826,644, issued May 2, 1989 shows a steel inner tank for fuels surrounded by both a polyeurethane spacer layer and a polyeurethane liner for secondary containment and, finally, completely entombed in concrete for protection from external hazards.

Cruver et al, U.S. Pat. No. 5,033,638, issued Jul. 23, 1991, discloses an inner steel tank supported by ribs and separated by an air space from an outer concrete casing. The air space is sized at 110% of the inner tank volume, and a sealant may be used on the inner surface of the concrete casing of Cruver et al to provide secondary containment for spills. Again, while the outer concrete casing of Cruver et al is formed from two identical halves, the casing completely entombs the inner tank in the concrete casing. In the event of a spill, loss of secondary containment at the seam between halves is possible.

Above ground storage tanks developed by others for chemical storage use polyethylene inner tanks for primary containment, and polyethylene liners for secondary containment. While effective in resisting chemical substances, polyethylene is expensive, and high mold costs are associated with providing tanks and/or liners for different sizes. Epoxy coatings for outer surfaces of concrete casings are also taught by others for above ground chemical storage tanks.

While generally effective in providing containment, these various above ground storage tanks suffer from a lack of access for inspection, repair and maintenance. Completely encased, the inner tanks may not be repaired or replaced except by destroying the outer casing. While the outer casing of Cruver et al has a horizontal seam between identical halves, access therethrough is problematic. Moreover, disassembly in the event of a spill comprises secondary containment, and may cause high levels of contained -materials to be released. Ready access, while desirable for inspection, repair and maintenance, has not been available due to the hazardous nature of intended uses. Where flammable materials are stored above ground, air gaps in the outer casing are undesirable sources of oxygen which present the possibility that a fire in a nearby structure could involve the stored materials, enhancing the risk of fire and explosion. Gaps or openings through which vapor or spills may leak are also undesirable. Thus, where spills occur in known storage apparatuses, access to clean up spilled material is problematic. As well, repair of damage or decay in the inner tank, or complete replacement thereof, is virtually impossible. Instead, it is necessary to completely dispose of the tank and casing, thus presenting a solid waste disposal problem.

Accordingly, improvements in the design of above ground storage tanks are desired to provide both environmentally sound storage as well as safe access for inspection and economical repair and maintenance.

SUMMARY OF THE INVENTION

The present invention satisfies this need by providing an above ground storage tank which is accessible for inspection, maintenance and repair, yet which is sealed to inhibit fire and explosion hazards.

The above ground storage tank of the present invention includes an inner tank for primary storage, and an outer casing surrounding the inner tank. The outer casing includes both a casing body defining an opening, and a removable lid positioned over the opening. In accordance with the present invention, means for sealing the removable lid to the casing body are included to inhibit fire and explosion hazards. The casing body and removable lid include opposing first and second surfaces, respectively. Preferably, the means for sealing is a fireproof or fire-resistant sealant material which is applied or disposed between the opposing first and second surfaces. Hereafter, reference to a fire-resistant seal or sealant material is understood to also include substantially fireproof seals and sealant materials. It is preferred to further add a weather-resistant sealant between the opposing first and second surfaces around the outer periphery of the fire-resistant seal, so that the weather-resistant sealant protects the fire-resistant sealant from moisture and the effects of weathering.

While removable lids for concrete-encased, above ground fuel and chemical storage tanks have, to date, been unfeasible, the present invention overcomes obstacles with regard to fire, explosion and leakage hazards to provide a structure resistant thereto. In field testing, flammable materials were found to be safely stored in the inner tank despite exposure of the present invention to external temperatures in the range of 2000 degrees Fahrenheit.

In addition to the fire-resistant seal around the removable lid of the present invention, fire-resistant seals with external weather-resistant sealant are also preferably provided at through holes in the removable lid through which pipes extend outward from the inner tank.

Accordingly, it is an object of the present invention to provide an above ground storage container which is safe for flammable or otherwise hazardous materials, and which is accessible for inspection, maintenance and repair. It is a further object of the present invention to provide such an above ground storage container which includes a removable lid sealed to an outer casing with a fire resistant sealant to inhibit the dangers presented by fires to materials stored in above ground storage hanks. It is a further object of the present invention to provide fire resistant seals to pipes which may extend through the removable lid from an inner tank within the outer casing.

These and other features and objects of the present invention will be apparent from the drawings, detailed specification and claims which follow.

DETAILED DESCRIPTION OF THE PREFERRED EMBODIMENTS

Figure 1:
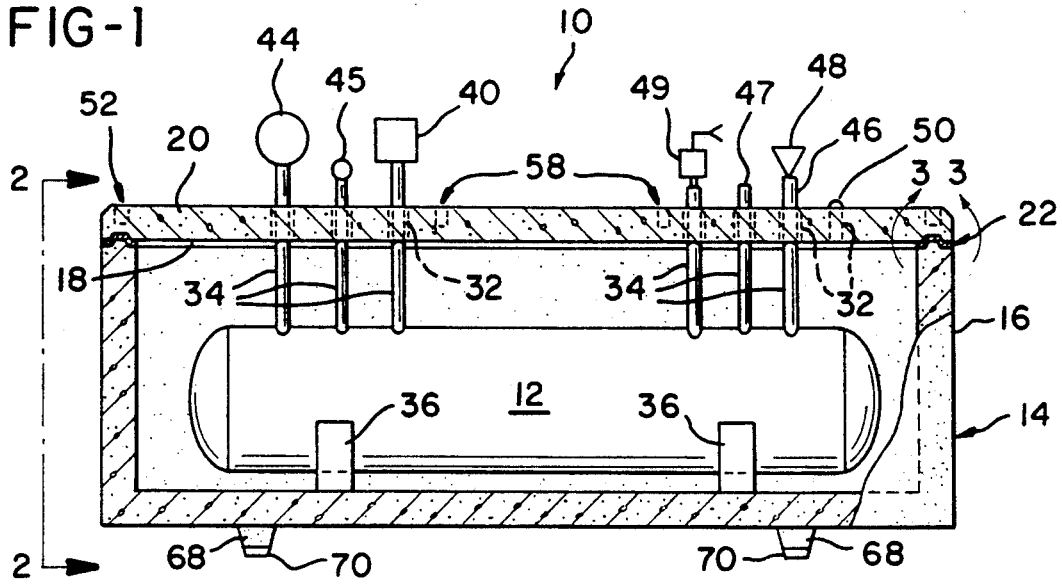
FIG. 1 is a front elevational view of the above ground storage tank of the present invention with the front panel cut away.
Figure 2:
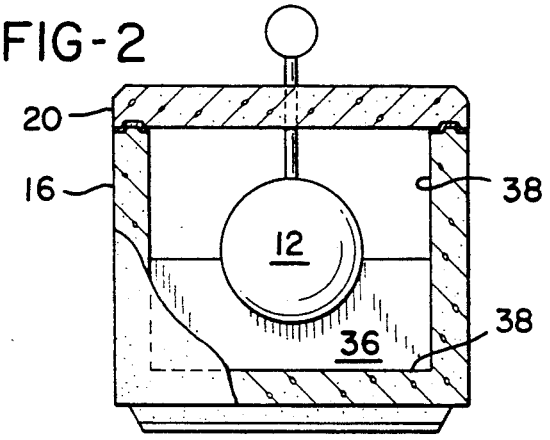
FIG. 2 is a side elevational view of the above ground storage tank of FIG. 1 with the end panel cut away.

Referring to FIGS. 1 and 2, the above ground storage tank 10 of the present invention is shown including an inner tank 12 for primary storage, and an outer casing 14 surrounding the inner tank 12. The outer casing 14 includes both a casing body 16 defining an opening 18, and a removable lid 20 positioned over the opening 18. In accordance with the present invention, means 22 for sealing the removable lid 20 to the casing body 16 are included to inhibit fire and explosion hazards.

Figure 3:
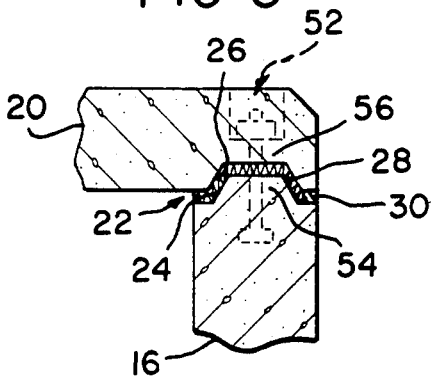
FIG. 3 is a detail cross-sectional view of the fire-resistant seal around the opening of the casing body taken at line 3—3 of FIG. 1.

Referring now to FIG. 3, the casing body 16 and removable lid 20 include opposing first and second surfaces 24, 26, respectively. Preferably, the means 22 for sealing is a fireproof or fire-resistant sealant material 28 which is applied or disposed between the opposing first and second surfaces 24, 26. Reference to a fire-resistant seal or sealant material is understood to include substantially fireproof seals and sealant materials. It is preferred to further add a weather-resistant sealant 30 between the opposing first and second surfaces 24, 26, around the outer periphery of the fire-resistant sealant 28, so that the weather-resistant sealant 30 protects the fire-resistant sealant 28 from weathering.

Figure 4:
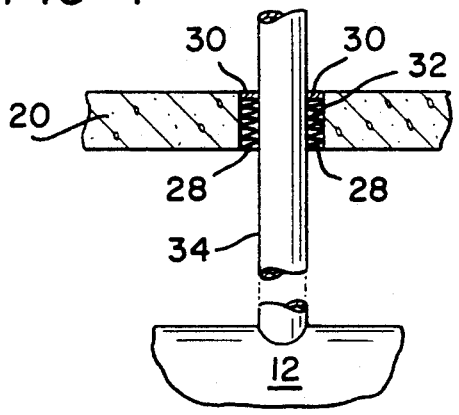
FIG. 4 is a detail cross-sectional view of a representative fire-resistant seal between a pipe and a through hole in the removable lid in FIG. 1.

As further shown in FIG. 4, in addition to the fire-resistant seal around the removable lid 20 of the present invention, seals with fire-resistant sealant 28 and external weather-resistant sealant 30 are also preferably provided at through holes 32 in the removable lid 20 through which pipes 34 extend outward from the inner tank 12.

Referring again to FIGS. 1 and 2, means 36 for mounting the inner tank 12 are representatively shown as a cradle which maintains the inner tank 12 is spaced relationship from the inner surface 38 of the casing body 16. It is understood that one or more inner tanks 12 can be mounted in the casing body 16. The volume of the casing body 16, exclusive of the volume of the inner tank 12 and the means 36 for mounting, is at least as great as the volume of the inner tank 12. Preferably, the body volume is 110% of the volume of the inner tank 12, and the body volume is available for secondary containment even where the removable lid 20 is removed. In addition, while the shape of the casing body 16 is rectangular, it is understood that the outer casing 14 can be shaped and sized to fit an inner tank 12 of any shape or size, and to be a particular shape as required by a specific application.

It is preferred that the casing body 16 and removable lid 20 components of the outer casing 14 are produced by monolithic concrete pours and comprise six inch thick precast reinforced concrete components. Standard concrete mixes are suitable, and an approximately 5000 psi mix is preferred. This structure is sufficiently durable to provide required fire protection, as well as prevent rupture of the inner tank 12 in the event of vehicle impact. The inner tank 12 is preferably made of steel for storage of fuels and lubricants, or made of cross-linked polyethylene for chemical storage. The fire-resistant sealant material 28 is preferably a blanket-type material which may be applied by positioning the material between the first and second mating surfaces 24, 26. It is preferred to use a fire-resistant material commercially available as an alumina silica ceramic fiber blanket known as Inswool-HpT TM blanket from A.P. Green Industries, Inc., Mexico, Mo. Another ceramic fiber alumina silica blanket material is sold as Kaowool TM strip by Thermal Ceramics of Augusta, Ga., and CERA Blanket TM is available from Johns Manville of St. Louis. These materials have maximum temperature ratings in the range of 2300–2400 degrees Fahrenheit, and melting temperatures above 3200 degrees Fahrenheit. Other commercially available fire-resistant and fire-proof sealants may be suitable. The weather-resistant sealant 30 is preferably a caulk-type, commercially available urethane sealant, such as a modified urethane sealant sold as Dymonic TM by Tremco of Cleveland, Ohio.

Also shown in FIGS. 1 and 2, one or more pipes 34 may extend outward from tank 12. Six pipes 34 are illustratively shown, and are used to perform different functions. For example, one pipe 34 serves as a fill pipe or fill port 40 having an overflow module or spill catch volume attached. Another pipe 34 has a dispensing unit 44, such as a pump, attached thereto for dispensing materials from the inner tank 12. Another pipe 34 may serve as a vent line 46, and includes a fire-safe vent cap 48 attached thereto of a type which is known in the art. Other pipes 34 may be used for mounting a gauge 45, or a vapor recovery port 47 for use during filling, or a vapor vent with a pressure relief valve 49. As well, an extra through hole 32 may be provided in the removable lid 20 for installation of a visible sight tube 50 for leak detection, or a leak sensor.

Shown best in phantom in FIG. 3, means 52 for removably securing the removable lid 20 to the casing body 16, such as fasteners, are shown which interconnect the removable lid 20 to the casing body 16. While fasteners of many types are possible, it is preferred to install bolts spaced around the opening 18 with their heads down in the casing body 16 at the time of pouring. So installed, the bolt threads extend upward from the first surface 24, and through the holes provided in removable lid 20. The holes include a wider diameter portion which allows nuts to be engaged on the ends of the bolts and recessed in the removable lid 20.

Provision of the removable lid 20, secured in accordance with the present invention, provides an additional benefit. In the unlikely event that an explosion hazard from within the above ground storage tank is realized, the removable lid 20, means 22 for sealing, and means 52 for removably securing, may be designed to fail from outward projecting explosion forces at a lower level than the casing body 16. As a result the force of any explosion will tend to be channeled upward through the opening 18 away from personnel, rather than outward in all directions.

Also shown in FIG. 3 are surface features on the first and second surfaces 24, 26 which positively locate the removable lid 20 in position on the casing body 16 over the opening 18. The surface feature is preferably a mating tongue-in-groove type joint having a tongue 54 in the casing body 16 and a groove 56 in the removable lid 20. Such a connection also serves to prevent a direct line of sight from the outside to the inside of the outer casing 14, as is desirable to protect the inner tank 12 from line of sight exposure to an external heat source. As well, at least a portion of the fire-resistant sealant 28 is similarly protected.

Figure 5:
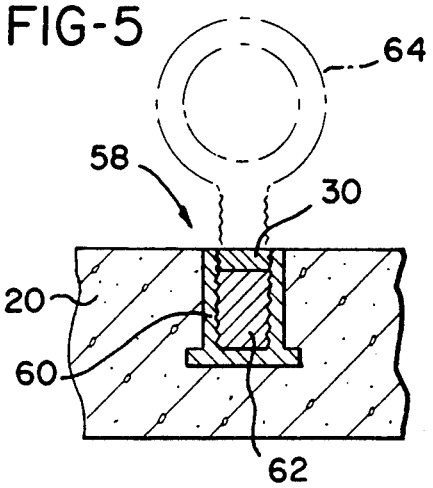
FIG. 5 is a detail cross-sectional view of the means for removing the removable lid of the present invention.

Referring now to FIG. 5, a detail of the removable lid 20 is shown including means 58 for removing the removable lid 20 from the casing body 16 (not shown). Preferably, the means for removing comprises a threaded socket 60 in the removable lid 20 into which removable plugs 62 are screwed and sealed with weather-resistant sealant 30 during non-use to prevent corrosion, as shown. When used for lifting the removable lid 20, which will occur rarely during the lifetime of the above ground storage tank in most applications, lifting bolts 64, such as eye-bolts (shown in phantom), are threaded into the sockets 60 upon removal of the plugs 62. The exact spacing of the means 58 for removing, representatively shown in FIG. 1, depends on the size and shape of the removable lid 20, which is shown as substantially flat in FIGS. 1 and 2.

Figure 6:
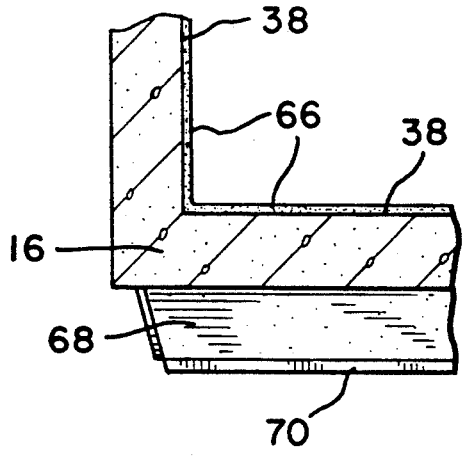
FIG. 6 is a detail cross-sectional end view of the above ground storage tank having a sealant applied to a representative portion of the inner surfaces of the casing body.

As shown in FIG. 6, in accordance with the present invention, a sealant 66 may also be added to the inner surface 38 of the casing body 16 and the removable lid 20 to provide secondary containment for material stored in inner tank 12. In accordance with the present invention a sealant 66 including a thermosetting resin mixed with a graded aggregate, may be used to coat the inner surfaces 38 of the casing body 16 and the removable lid 20 to such that the inner surfaces of the concrete outer casing 14 provide secondary containment of spilled material. Such sealant is particularly suited for secondary containment of chemicals. One such sealant is manufactured under the tradename OVERCOAT by Rust-Oleum of Tulsa, Okla., and is described in U.S. Pat. No. 4,761,313 for coating the floors and curbs present in chemical storage areas. This sealant results in a non-porous surface which fills any voids in the concrete inner surfaces 38, and has a bond strength in excess of the concrete. For ease of application, however, a water and polymer-based sealant, ConSeal 90 manufactured by Concrete Sealants Inc., New Carlisle, Ohio, is preferred. This sealant is also preferred for secondary containment of fuels.

Further shown in detail in FIG. 6 is a footpad 68 which extends outward from the casing body 16 for support thereof. No separate stand or support system is thereby required. Rather, the footpad 68 further includes an outer weight-supporting portion 70 of resilient material which assists in stabilizing the above ground storage tank 10 during use. Minor imperfections in the grade of a pad upon which the above ground storage tank 10 is received can be effectively overcome by the resilient material, and prevent undesirable rocking or instability of the above ground storage tank 10. The resilient material is preferably a neoprene bearing pad, which is weather resistant, durable, and appropriately resilient under anticipated loads. A 60 durometer ½ inch pad has been found to obtain the desired stability and leveling for storage containers having 500 to 1000 gallon capacities.

Figure 7:
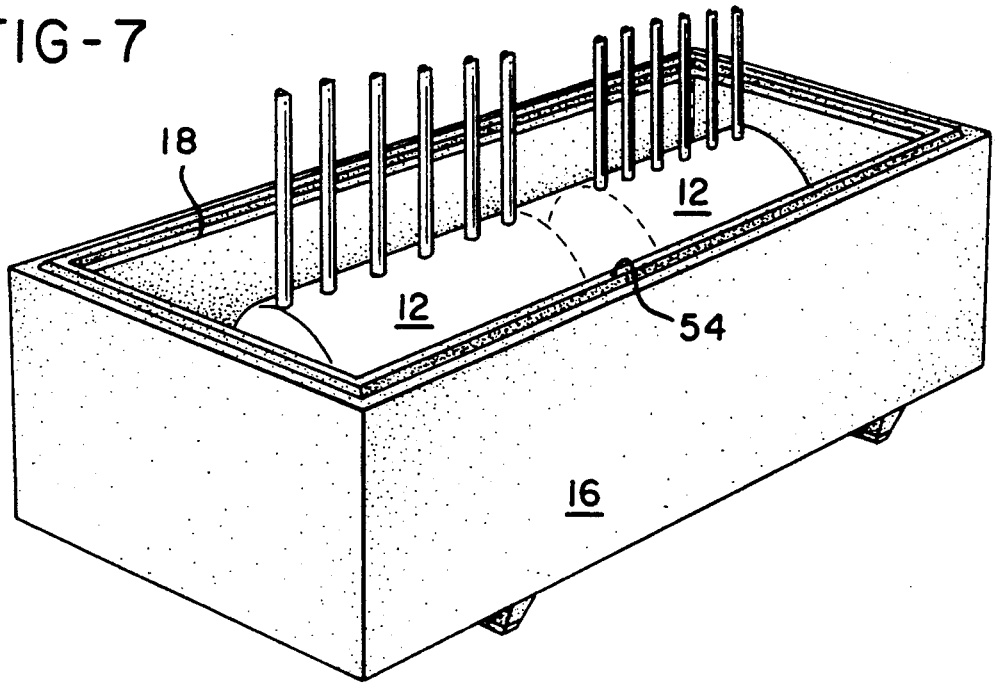
FIG. 7 is a schematic perspective view of the present invention including a compartmental tank, with the removable lid removed for clarity.

In a further configuration of the present invention, shown in FIG. 7, it is understood that one or more inner tanks 12 can be placed in the casing body 16, depending on the application. Preferably, where multiple tanks are provided, it is preferred to use a compartmental tank, as shown, to reduce the number of means 36 for mounting required (not shown), and to provide cost savings. Separate tanks are possible, but not preferred. Further, a partition wall (not shown) may be added to divide the casing body 16 into first and second volumes to provide separate secondary containment where, in the event of a spill, mixture of stored materials would be undesirable, or one material is inimical to the material of a companion tank. In the partition wall alternative, it may be desirable to further provide a surface feature and fire-resistant seal (also not shown) along the top edge of the partition wall, such as is provided around the opening 18, for more complete sealing. The removable lid 20 and fire-resistant sealant material 28 are not shown in FIG. 7 for clarity, but it is understood that such are positioned over and around the opening 18, respectively, to seal the inner tanks 12 in the casing body 16.

Figure 8:
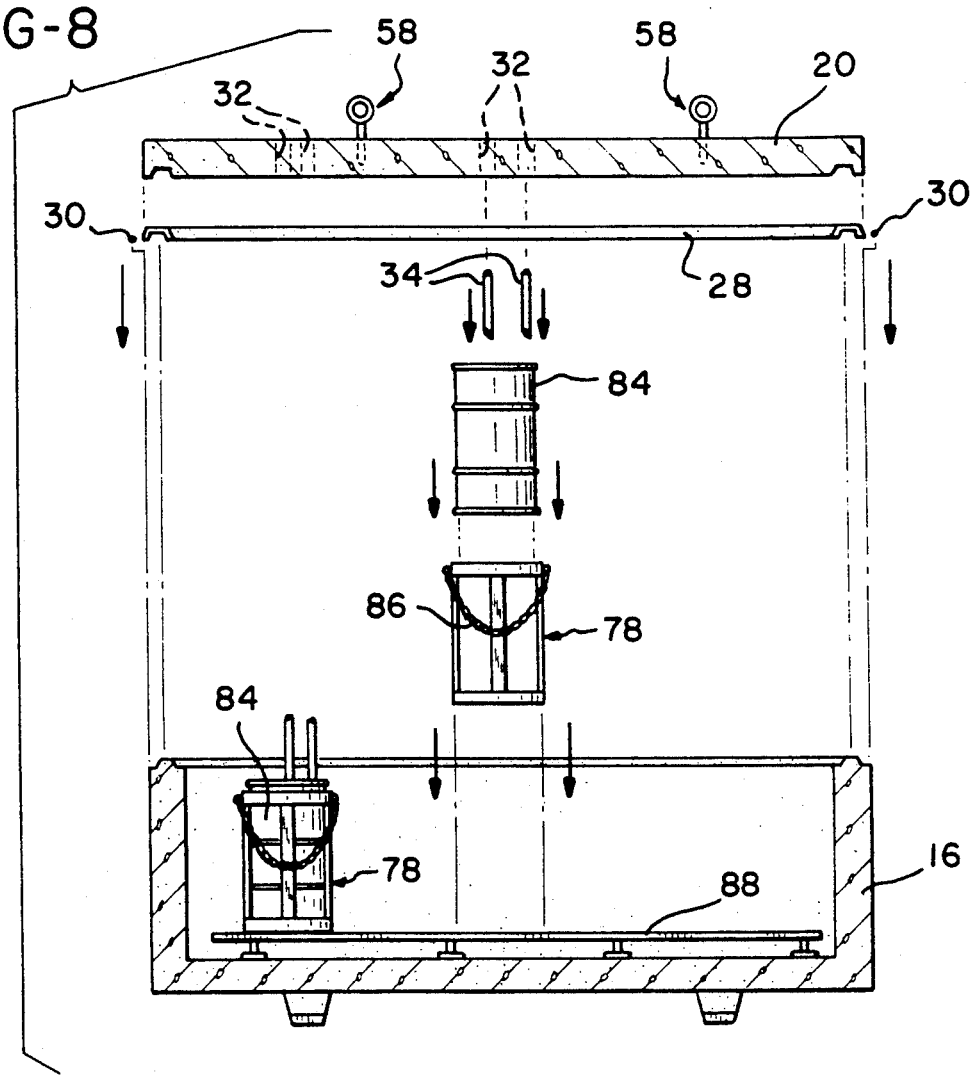
FIG. 8 is an exploded view of a further embodiment of the present invention with the front panel cut away representatively showing removable tanks.
Figure 9:
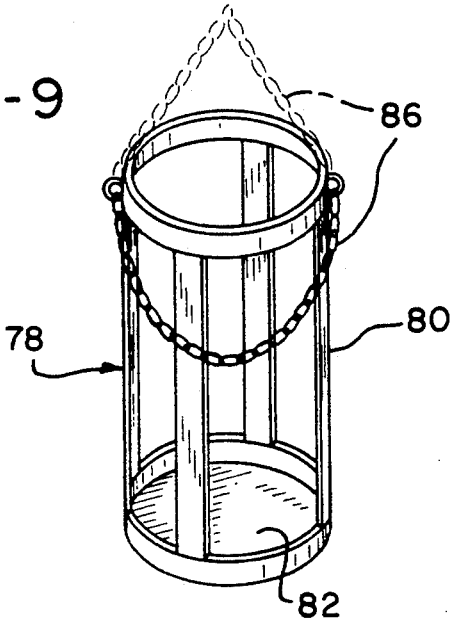
FIG. 9 is a detail perspective view of the lifting structure of FIG. 8.

A further configuration of the present invention is shown in FIG. 8 where removable ones of a plurality of inner tanks 12 are received and stored in casing body 16. Instead of the means 22 for mounting of FIGS. 1 and 2 previously described, this embodiment of the present invention receives the inner tanks 12 in means for removably disposing the inner tanks in the outer casing 14. The means for removably disposing comprises a lifting structure 78. One such lifting structure 78 is representatively shown in greater detail in FIG. 9, and consists of a frame 80 having a bottom 82 which receives a drum or other container as the inner tank 12. A connecting element 82, such as the chain shown, is used to secure the lifting structure 78 to a crane, forklift or other lifting device for placement of the lifting structure 78 and drum 84 inside the casing body 16. Preferably, where material transfer is to occur to or from a drum 84, pipes 34 can be attached to the top of the drum 84 or container for pumping, venting and other purposes previously noted, and the removable lid 20 replaced on the casing body 16 and sealed in accordance with the present invention.

Preferably, a means for receiving the inner tank(s) 12 (e.g. drum 84), such as an elevated platform 88, is placed in the bottom of the casing body 16. The platform 88 preferably has holes or perforations (not shown) so that the inner tanks 12 and the lifting structures 78 do not rest in any spilled material in the casing body 16.

Again, a fire-resistant seal material 28 is used to produce a fire-resistant seal, and a weather-resistant seal material 30 used, as needed, for the application to protect the fire-resistant seal material 28 from weathering effects of the environment. Where frequent replacement of the removable lid 20 is expected, for example as with the embodiment of FIG. 8, to the fire resistant seal may be attached to at least one of the opposing first and second surfaces 24, 26.

Unless otherwise indicated, all materials used in the present invention are conventional, and commercially available.

While certain representative embodiments and details have been shown for purposes of illustrating the present invention, it will be apparent to those skilled in the art that various changes in the above ground storage tank disclosed herein may be made without departing from the scope of the invention, which defined in the appended claims.

What is claimed is:

1. An above ground storage tank which is sealed to inhibit fire and explosion hazards comprising:

an inner tank for primary storage; and an outer casing surrounding said inner tank, including:

a concrete casing body made of six inch thick precast reinforced concrete defining an opening;

a sealant on the inner surfaces of said concrete casing body for secondary containment of material stored in said inner tank, wherein said sealant comprises a thermosetting resin mixed with a graded aggregate;

a removable lid positioned over said opening;

said concrete casing body and said removable lid including opposing first and second surfaces, respectively; and means for sealing said removable lid to said concrete casing body which includes a fire-resistant sealant material disposed between said opposing first and second surfaces.

2. The above ground storage tank of claim 1 wherein said opposing first and second surfaces include mating surface features to locate said removable lid in position on said casing body over said opening.

3. The above ground storage tank of claim 1 further comprising a weather-resistant sealant between said opposing first and second surfaces and around the outer periphery of said fire-resistant sealant, whereby said weather-resistant sealant is positioned between the environment and said fire-resistant sealant.

4. The above ground storage tank of claim 1 wherein:

said removable lid includes at least one through hole;

said inner tank includes at least one pipe extending outward therefrom through said through hole; and said above ground storage tank further includes means for sealing said pipe to said removable lid, said means for sealing including fire-resistant sealant material.

5. The above ground storage tank of claim 1 further comprising means for removably securing said removable lid to said casing body.

6. The above ground storage tank of claim 5 wherein said means for removably securing comprise a plurality of bolts interconnecting said removable lid to said casing body.

7. The above ground storage tank of claim 1 wherein said removable lid is substantially flat.

8. The above ground storage tank of claim 1 further comprising footpads extending outward from said casing body for support thereof, said footpads including an outer weight-supporting portion of resilient material for stabilizing said casing body.

9. An above ground storage tank comprising:

an inner tank for primary storage having a plurality of pipes extending outward therefrom; and an outer casing surrounding said inner tank, including:

a casing body defining an opening of sufficient size to receive said inner tank in said casing body;

footpads extending outward from said casing body for support thereof, said footpads including an outer weight-supporting portion of resilient material for stabilizing said casing body;

means for mounting said inner tank in said casing body;

a generally planar removable lid positionable over said opening, said removable lid having:

a plurality of through holes each of which receives at least one of said plurality of pipes; and means for removing said removable lid from said casing body;

said casing body and said removable lid including opposing first and second surfaces, respectively, said surfaces including mating surface features to position said removable lid on said casing body over said opening;

means for sealing said lid to said casing body comprising fire-resistant sealant material disposed between said opposing first and second surfaces;

means for sealing said at least one pipe to said removable lid comprising fire-resistant sealant material disposed between said at least one pipe and said at least one through hole; and means for removably securing said removable lid to said casing body comprising a plurality of fasteners interconnecting said removable lid to said casing body.

10. The above ground storage tank of claim 9 wherein said at least one pipe comprises a plurality of pipes, ones of said pipes comprising:

a fill port having a spill catch volume attached thereto;

a pump line having a pump attached thereto; and a vent line for vapor exhaust from said inner tank including a fire safe vent cap attached thereto.

11. The above ground storage tank of claim 9 wherein said means for removing includes:

threaded sockets in said removable lid;

removable plugs to seal said threaded sockets during non-use; and lifting bolts threadably engagable in said threaded sockets upon removal of said plugs.

12. The above ground storage tank of claim 9 wherein:

said above ground storage tank further comprises means for mounting said inner tank in said outer casing in spaced relationship from the inner surfaces of said outer casing; and said casing body includes a body volume, exclusive of the volume of said inner tank and said means for mounting, at least as great as the volume of said inner tank.

13. The above ground storage tank of claim 9 wherein said outer casing further includes a sealant on the inner surfaces thereof for secondary containment of material stored in said inner tank, wherein said sealant comprises a polymer-based sealant.

14. The above ground storage tank of claim 13 wherein said sealant on the inner surfaces of said outer casing for secondary containment of material stored in said inner tank comprises a thermosetting resin mixed with a graded aggregate.

15. The above ground storage tank of claim 9 wherein:

said above ground storage tank further comprises:

a partition wall defining first and second volumes in said casing body; and a plurality of inner tanks; and at least one inner tank is disposed in each of said first and second volumes.

16. The above ground storage tank of claim 9 further comprising means for removably disposing said inner tank in said outer casing.

17. The above ground storage tank of claim 16 wherein said means for removably disposing comprises a lifting structure.

18. The above ground storage tank of claim 16 further comprising:

a plurality of inner tanks;

a plurality of means for removably disposing said inner tanks; and means for receiving said plurality of inner tanks, said means for receiving disposed in said casing body.

* * * * *